US005288340A

United States Patent [19]

Christ et al.

[11] Patent Number: 5,288,340

[45] Date of Patent: Feb. 22, 1994

[54] METHOD OF IMPROVING THE CORROSION RESISTANCE OF CARBONITRIDED COMPONENTS MADE OF FERROUS MATERIALS

[75] Inventors: Ulrich Christ, Karlstein; Helmut Kunst; Georg Wahl, both of Rodenbach, all of Fed. Rep. of Germany

[73] Assignee: Degussa Aktiengesellschaft, Frankfurt am Main, Fed. Rep. of Germany

[21] Appl. No.: 746,427

[22] Filed: Aug. 16, 1991

[30] Foreign Application Priority Data

Aug. 27, 1990 [DE] Fed. Rep. of Germany ..... 4027011

[51] Int. Cl.[5] ..... C23C 8/32

[52] U.S. Cl. ..... 148/217; 148/218; 148/219; 427/327

[58] Field of Search ..... 148/217, 218, 219, 248, 148/251, 257, 274; 427/327, 419.5

[56] References Cited

U.S. PATENT DOCUMENTS

| | | | |
|---|---|---|---|
| 4,748,055 | 5/1988 | Landers et al. | 148/257 |
| 4,950,365 | 8/1990 | Evans | 427/327 |
| 5,037,491 | 8/1991 | Fox | 148/218 |
| 5,094,889 | 3/1992 | Hayner et al. | 427/327 |

*Primary Examiner*—George Wyszomierski
*Attorney, Agent, or Firm*—Beveridge, DeGrandi, Weilacher & Young

[57] ABSTRACT

In order to improve the corrosion resistance, carbonitrided components formed of ferrous material are treated, after an oxidation treatment, with a solution of a heat hardenable organic synthetic resin and heat-treated at 80° to 200° C.

8 Claims, No Drawings

METHOD OF IMPROVING THE CORROSION RESISTANCE OF CARBONITRIDED COMPONENTS MADE OF FERROUS MATERIALS

INTRODUCTION AND BACKGROUND

The present invention relates to a method of improving the corrosion resistance of carbonitrided components formed from ferrous material, which are subjected after the conventional carbonitriding process to one or more conventional oxidation treatments and, if necessary, to a conventional mechanical treatment, by coating them with a thin layer of an organic synthetic resin material.

The corrosion resistance of parts and components made of ferrous material which were carbonitrided and quenched from the carbonitriding temperature in water or oil is considerably improved over the untreated state. It is of no consequence whether the carbonitriding treatment took place in a salt bath, in gas or in plasma. Carbonitriding of ferrous objects is well understood in the art and the term is used herein in its recognized meaning.

A further increase in the corrosion resistance can be achieved if an oxidation treatment takes place following the carbonitriding. This can take place, for example, by means of a water vapor treatment in a temperature range of 500° to 580° C. Moreover, the oxidation following the carbonitriding can be carried out in an oxidizing salt bath, as described for example in DE patent 29 34 113. Such oxidation processes are well known in the art.

If the carbonitriding process is carried out in a salt bath, the oxidation process should follow immediately, that is, the ferrous components are to be switched in a suspended state without intermediate cooling directly from the carbonitriding bath into the oxidizing bath. If, on the other hand, the ferrous components are carbonitrided in gas or plasma, they must generally be cooled at first to room temperature and the oxidation is subsequently brought about by suspending the ferrous components in the salt bath. A considerable increase in the corrosion resistance of the ferrous parts also results in this method of procedure; however, it is less than in the case of salt bath carbonitriding with direct oxidation in the salt bath without intermediate cooling.

A further increase of the corrosion resistance of the ferrous products is possible if the oxidation treatment is followed by a mechanical surface treatment (e.g. polishing, lapping, slide grinding) and another oxidation. The corrosion resistance values achieved with this method of operation (e.g. in a salt spray test) are comparable to or better than those of qualitatively first-class galvanic coatings.

EP patent 0,077,627 teaches a method of providing carbonitrided components formed of ferrous material with an oxide layer and of then quenching them. The components can be subsequently provided with a thin coating of wax. However, this wax film does not entail any appreciable increase in corrosion resistance in practice.

SUMMARY OF THE INVENTION

A object of the present invention therefor is to provide a method of improving the corrosion resistance of carbonitrided components formed of ferrous material, which are subjected after the carbonitriding step to one or more oxidation treatments and, if necessary, to a mechanical treatment.

In achieving the above and other objects, one feature of the invention resides in coating the so obtained carbonitrided ferrous components with a thin layer of an organic synthetic resin material which results in a significant improvement of the corrosion resistance without altering the other mechanical properties or their optical appearance.

Another feature of the invention involves immersing the carbonitrided and otherwise pretreated ferrous components in a 1–40% solution of a hardenable synthetic resin in water and/or inert organic solvents and then heat-treating for 2 to 30 minutes at 80° to 200° C.

DETAILED DESCRIPTION OF INVENTION

In carrying out the present invention, the ferrous component of any desired shape, form or configuration is first subjected to the conventional carbonitriding treatment as well as one or more conventional after-treatments as described above. These techniques are well known and any suitable ones can be used for the pretreatment according to the invention. Following the pretreatment, the ferrous object is contacted with the organic resin solution. Although any suitable method of contacting the ferrous article with the solution can be used, immersion has been found to be most suitable.

A solution is preferably used which contains 5° to 25% weight of a heat-hardenable synthetic organic resin. In addition to epoxide resins, melamine resins, polyester resins and polyurethane resins, the alkyd resins, acrylate resins and phenolic resins have proved to be the best-suited for this purpose. All of these resins are conventional and well know in the art. The temperature and the time of the heat treatment are a function of the specific type of artificial resin used and are matters well understood in the art. The synthetic resins can be used in pure or modified form. These products are well known in the art. The solution is selected with advantage in such a manner that a layer of artificial resin with a thickness of 0.2° to 5 μm is produced on the ferrous article.

Any suitable inert organic solvent capable of dissolving the resin can be used for purposes of the invention.

As a result of this above described post-treatment, of the pretreated components, in accordance with the invention, the corrosion resistance of the end product is surprisingly increased quite considerably. Values are achieved which far exceed the purely protective action of a thin layer of synthetic resin. Thus, the corrosion resistance in a salt spray test according to DIN 50021 is increased by several multiples. Even after 3000 hours, several specimens show no attack by corrosion in a salt spray test (see table). The fatigue strength and the wear resistance of the ferrous component are retained and its color is not changed. As a result of the posttreatment, the surface roughness is also reduced. This is generally desirable but can also be undesirable in individual instances (altered sliding properties, oil adhesion). The use of suitable additives to the immersion bath for the posttreatment can alter the roughness depth within broad limits. A potential additive is e.g. highly dispersed silica.

The following examples are intended to illustrate the method of the invention in more detail:

Specimens of steel Ck35 with dimensions of 10 mm diameter and a length of 150 mm were used. For reasons of statistical reliability, 10 specimens per test were used which were treated completely in the same manner, namely, simultaneously in one charge. The salt spray test according to DIN 50021 served as the corrosion test and the failure criterion was taken as the first visible corrosion point. The table below shows the mean value of the ten specimens, the standard deviation and the lowest and the highest values. The test was generally terminated after 3000 hours. Specimens which were still free of corrosion in the test after this time were rated at 3000 hours in the calculation of average value and standard deviation.

Example 1. The 10 specimen ferrous components were subjected to the salt spray test without carbonitriding treatment and without the organic coating.

Example 2. Ten non-pretreated ferrous components were immersed for 1 minute in an aqueous solution of an alkyd resin, dried 10 minutes at 80° and heated for 10 minutes at 160° C. The alkyd resin solution consisted of 25 parts by weight of an alkyd resin modified with epoxide resin in 280 parts by weight of a water—methoxypropoxypropanol mixture (ratio 20: 1).

Example 3. Ten non-pretreated ferrous components were immersed for 2 minutes in an acrylate resin solution, dried for 30 minutes at 80° C. and heated for 10 minutes at 100°. The acrylate resin solution consisted of 10 parts by weight of an acrylate resin with 1.4% OH groups in 200 parts by weight xylene butylacetate (ratio 8:2).

Example 4. Ten non-pretreated components were immersed for 5 minutes in a phenolic resin solution of 10 parts by weight of a phenolic resin and 200 parts by weight toluene, dried 10 minutes at 80° C. and heated for 30 minutes at 180° C.

Example 5. Ten ferrous components were first carbonitrided for 90 minutes at 580° C. in a salt bath (37% cyanate, 1.3% cyanide, remainder carbonate and cations), then oxidized after cooling off for 10 minutes at 370° C. in a salt bath of alkali hydroxide with 10% sodium nitrate and subsequently quenched in water of 20° C.

Example 6. Ten components carbonitrided according to the same procedure as in example 5 were immersed following the same procedure as in example 2 in an alkyd resin solution and posttreated in the same manner as in example 2.

Example 7. Ten components carbonitrided according to the same procedure as in example 5 were immersed according to the same procedure as example 3 in an acrylate resin solution and posttreated as was done in example 3.

Example 8. Ten components were carbonitrided according to the same procedure as in example 5 and then were immersed according to the same procedure as in example 4 in a phenolic resin solution and posttreated as in example 4.

Example 9. Ten components were carbonitrided and oxidized as was done in example 5, then mechanically treated with slide grinding, re-oxidized 10 minutes in a salt bath and quenched in water of 20° C.

Example 10. Ten components pretreated according to the same procedure as in example 9 were immersed according to the steps taken in example 2 in an alkyd resin solution and posttreated following the same steps as in example 2.

Example 11. Ten components were pretreated according to the same procedure as in example 9 and were then immersed in an acrylate resin solution and posttreated according to the same procedure as in example 3.

Example 12. Ten components were pretreated according to the same process steps as in example 9 and then were immersed in a phenolic resin solution and posttreated following the same procedure as in example 4.

Example 13. Ten components were carbonitrided at 580° C. in gas (120 minutes in a gas mixture of 50% by volume ammonia and 50% by volume exothermic atmosphere and 60 minutes in a gas mixture of 50% ammonia and 50% endothermic atmosphere). The cooling took place in pure nitrogen. They were then oxidized 60 minutes at 550° C. in water vapor and slowly cooled down.

Example 14. Ten components were carbonitrided and oxidized according to the same procedure as in example 13 and were immersed in an alkyd resin solution and posttreated following the same procedure as in example 2.

Example 15. Ten components were pretreated according to the same treatment described in example 13 and were then immersed according to the steps in example 3 in an acrylate resin solution and posttreated following the procedure of example 3.

Example 16. Ten components pretreated according to the same procedure as in example 13 were immersed in a phenolic resin solution and posttreated according to the procedure of example 4.

The ferrous components treated herein can be of any suitable shape such as a rod of steel.

Further variations and modifications of the foregoing will be apparent to those skilled in the art and are intended to be encompassed by the claims appended hereto.

German priority document P 40 27 011.4 is incorporated herein by reference and relied on.

TABLE

| | Duration of salt spray in hours | | | | |
|---|---|---|---|---|---|
| Ex. | Avg. Value | Std. deviation | Lowest value | Highest value | Specimens still in the test (>3000 h) |
| 1 | 4 | 1 | 3 | 6 | |
| 2 | 20 | 3 | 16 | 24 | |
| 3 | 25 | 5 | 20 | 32 | |
| 4 | 17 | 5 | 12 | 24 | |
| 5 | 331 | 234 | 144 | 744 | |
| 6 | >2002 | 758 | 1008 | 3000 | 3 |
| 7 | >1654 | 717 | 912 | 3000 | 1 |
| 8 | >1912 | 742 | 960 | 3000 | 2 |
| 9 | 379 | 176 | 288 | 864 | — |
| 10 | >2900 | 213 | 2496 | 3000 | 8 |
| 11 | >2189 | 368 | 1992 | 3000 | 1 |
| 12 | >2652 | 378 | 2160 | 3000 | 5 |
| 13 | 185 | 20 | 168 | 216 | — |
| 14 | 1386 | 595 | 888 | 2616 | — |
| 15 | >2033 | 601 | 936 | 3000 | 3 |
| 16 | 1660 | 675 | 1008 | 2784 | |

The ">" signifies that the true average value is greater.

We claim:

1. A method of improving the corrosion resistance of a carbonitrided component formed of ferrous material, which has been subjected after the carbonitriding to oxidation, comprising coating said component with a thin layer of an organic synthetic resin by applying to said component a 1–40% solution of a heat hardenable organic synthetic resin in water and/or an inert organic solvent and then heat-treating for 2 to 30 minutes at 80° to 200° C.

2. The method according to claim 1, wherein the solution contains 5 to 25% by weight of a heat-hardenable synthetic resin.

3. The method according to claim 1 wherein the resin is an alkyd resin, acrylic resin, phenolic resin or mixture thereof.

4. The method according to claim 1 wherein the resin is an epoxide, melamine, polyester or polyurethane resin or mixture thereof.

5. The method according to claim 1 further comprising carrying out said method so that said coating formed is 0.2 to 5 μm in thickness.

6. A method for improving the corrosion resistance of a carbonitrided component formed of ferrous material, comprising:

subjecting said ferrous material to carbonitriding to form a carbonitrided component, coating said component with a thin layer of a heat hardenable organic synthetic resin and then subjecting said coated component to a temperature of 80° to 200° C. for a period of 2 to 30 minutes, to form a thin layer of an organic synthetic resin material on the surface of said ferrous component to thereby improve the corrosion resistance thereof as compared to a component which had not been subjected to the carbonitriding.

7. The method according to claim 6 wherein said coating is performed by immersing said component, into a 1 to 40% solution of a heat hardenable organic synthetic resin in water.

8. The method according to claim 6 wherein said coating is 0.2 to 5 μm in thickness.

* * * * *